US005548500A

United States Patent [19]

MacKay

[11] Patent Number: 5,548,500

[45] Date of Patent: Aug. 20, 1996

[54] LAMP FIXTURE WITH ADJUSTABLE LAMP SOCKET

[76] Inventor: Iain N. B. MacKay, R.R. #2, Beeton, Ontario, Canada, L0G 1A0

[21] Appl. No.: 502,716

[22] Filed: Jul. 14, 1995

[51] Int. Cl.[6] ..... F21S 3/02

[52] U.S. Cl. ..... 362/427; 362/428; 362/429; 362/422

[58] Field of Search ..... 362/427, 428, 362/429, 432, 422

[56] References Cited

U.S. PATENT DOCUMENTS

| | | | |
|---|---|---|---|
| 1,309,051 | 7/1919 | Willman | 362/429 |
| 1,709,804 | 4/1929 | Paiste | 362/429 |
| 4,450,507 | 5/1984 | Gordin | 362/428 |
| 5,140,507 | 8/1992 | Harwood | 362/428 |

FOREIGN PATENT DOCUMENTS

| | | | |
|---|---|---|---|
| 460644 | 6/1928 | Germany | 362/427 |
| 144092 | 11/1979 | Japan | 362/427 |

*Primary Examiner*—Larry Jones
*Assistant Examiner*—Alfred Basichas
*Attorney, Agent, or Firm*—Trevor C. Klotz

[57] ABSTRACT

A novel electrical lamp fixture of the type having a lamp housing, a housing axis, a housing sidewall co-axial with the housing axis and a lamp receiving socket supported interiorly of the housing by a housing support means is disclosed and is also of the type which has an exterior support for the housing and which is pivotally connected to the housing. By extending this pivot connection through an elongate slot provided in the co-axial sidewall of the housing, it is possible to adjust the relative angular positioning of the housing to its support and simultaneously adjust the location of the lamp receiving socket along a length of the housing axis in a one-step operation. Locating the lamp receiving socket in different axial positions within the housing is desired when light bulbs of different axial lengths are employed in the same lamp receiving housing.

9 Claims, 2 Drawing Sheets

LAMP FIXTURE WITH ADJUSTABLE LAMP SOCKET

BACKGROUND OF INVENTION

This invention relates to a novel electric light fixture of the type having a lamp receiving housing, a lamp receiving socket within the housing and an exterior housing support which is pivotally connected to a sidewall of the housing and in which the lamp receiving socket can be adjustably moved or positioned along an axial length of the axis of the housing while simultaneously adjusting the relative pivotal positioning of the lamp support connected to the lamp housing.

SUMMARY OF INVENTION

A standard household lamp or light bulb ("A" lamp) is approximately 10.6 cm. in length whereas comparable reflector type lamps ("R" lamps) and halogen parabolic lamps ("Par." lamps) are approximately 10 cm. and 8 cm. in length, respectively. As differing lengths of lamps can be used in the same electric light fixture and because the lamp receiving socket is normally located in a fixed position along the axis of the surrounding lamp housing, the use of lamps of differing lengths can result in the free or distal end of the lamp, relative to the opening of the lamp housing, either being located too far within or projecting too far out of the housing.

A known electric lamp fixture of the type which this invention relates is manufactured by Hardcraft Industries Limited of Markham, Ontario, Canada and marketed under Model 29612. The lamp housing of this prior art fixture is supported by housing support means exterior of the housing and which is connected to the housing by pivot means which permits the housing to be adjustably positioned relative to its support about the pivot means. No provision is made for the adjustable positioning of the lamp receiving socket along a length of the housing axis.

Another known lighting fixture produced by Hardcraft Industries Limited and marketed under Model No. 22060 does make provision for adjustably moving the lamp receiving socket along an axial length of its housing. This particular lamp fixture employs socket support means which is connected to the lamp receiving socket and slidably connected to a sidewall of the housing along an elongate slot. The lamp receiving socket is permitted to move along an axial length of the housing axis by means of a thumb screw which extends through the slot and is connected to the socket support so that upon screw tightening, the socket by means of its associated socket support, can be held in any desired axial position along a length of the housing axis.

However, in this second known prior art fixture, the housing support is not directly pivotally connected to a sidewall of the housing, but rather is pivotally connected to one or more flanges or tangs which extend outwardly from the housing sidewall. Consequently, separate adjustment operations are required, one being to pivot and fix the lamp housing in a selected position relative to its housing support, and the other being to move and fix in a desired location the lamp receiving socket relative to its surrounding lamp housing.

The lighting fixture of this invention is of the type as described in connection with Hardcraft Model 29612 but which includes the moveable lamp receiving socket feature found in its Model No. 22060, so that the above described two step operation of selective positioning of the support to the housing and the selective positioning of the lamp receiving socket along a length of the axis of the housing can be performed in one adjustment step. Moreover, in addition to being easier to adjust from the installer or end user standpoint, the novel light fixture of this invention is easier to fabricate and assemble as it requires fewer parts resulting in a saving of cost of materials and assembly time.

In accordance with this invention, the foregoing is achieved by employing novel means for adjustably positioning the lamp receiving socket along a length of the housing axis and which includes an elongate slot provided in the said portion of the housing sidewall so that the socket support means can be directly connected to the housing support means by utilizing the existing pivot means, but which in this instance, extends through the slot. This permits the lamp housing to pivot relative to its lamp support while simultaneously enabling the lamp receiving socket to move along a length of the housing axis.

Although the elongate slot may extend in an inclined direction relative to the housing axis, in its preferred form of construction, the slot extends in a direction substantially parallel to this axis. Further, and in order to ensure that the moveable lamp receiving socket remains in alignment with the housing axis at all times, guide means extending into the slot can be advantageously employed in order to constrain the socket support means carrying the lamp receiving socket to only slidingly move along the elongate slot.

In order to maintain the housing and housing support in any selected pivotal position and to maintain the lamp receiving socket at a selected location along the housing axis, the pivot means which extends through the slot can, if desired, also frictionally interconnect the socket support means, the housing support means and the lamp housing together so that they remain fixed in a selected position following adjustment. Alternatively, and in the preferred arrangement, the foregoing can be achieved by using pivot means which is in the form of a thumb knob or screw which at one end extends through an aperture in the housing support and at its other end, is connected to a threaded opening in the socket support so that the assembly can be locked, by screw tightening in any selected pivotal and socket location position. In yet another alternative arrangement, a plurality of notches can be provided along one side of the elongate slot so as to receive and retain the pivot means which extend through the slot.

DETAILED DESCRIPTION OF DRAWINGS

Figure 1:
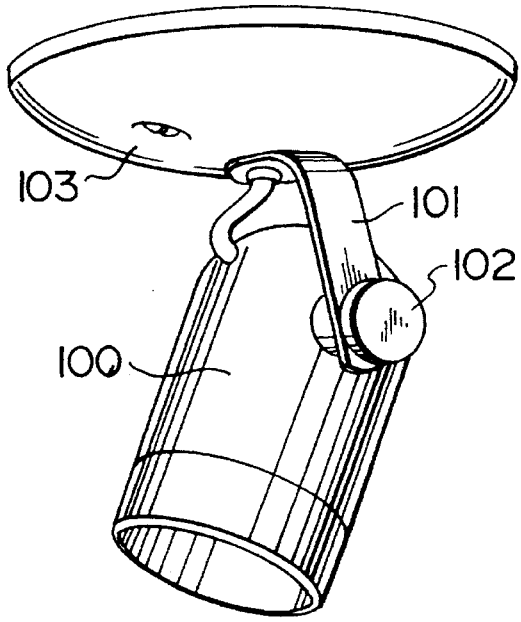
FIG. 1 PRIOR ART
FIG. 1 and FIG. 2 are perspective views of prior art electrical lamp fixtures of the general type to which this invention relates.

The prior art lamp fixture illustrated in FIG. 1 is manufactured by Hardcraft Industries Limited under Model No. 29612. As shown, the major exterior components of this fixture comprise lamp receiving housing 100 and housing support 101 which are pivotally connected together with thumb screw 102. Screw 102 also permits lamp receiving housing 100 and housing support 101 to be held or secured together in any selected angular relationship. Housing support 101 of the fixture as shown is L-shaped and in this instance, connected to a cover or base attachment plate 103 so that the fixture at its point of connection can swivel or rotate relative thereto, in a manner well known in the art.

Figure 2:
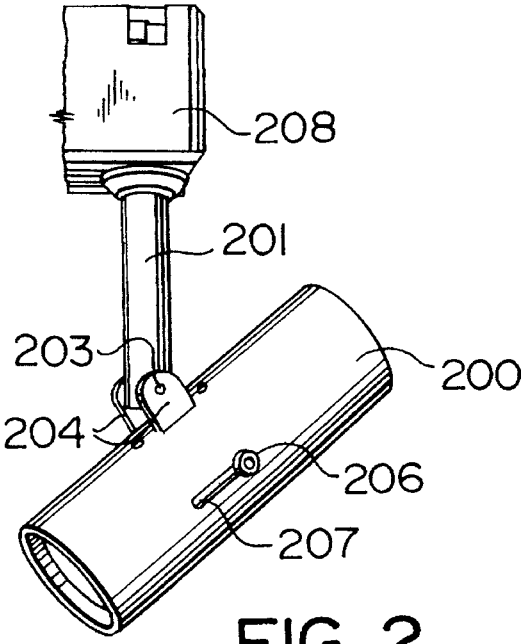
FIG. 2 PRIOR ART

The prior art fixture as seen in FIG. 2 (Hardcraft Model 22060), like Model 29612 has a lamp receiving housing 200 and a housing support 201. Tangs or flanges 204 project outwardly from the sidewall of lamp receiving housing 200 and are pivotally connected to housing support 201 in order to facilitate angular adjustment between the support 201 and housing 200. Support 201 itself is rotationally supported from a suitable base such as base 208 as illustrated. Also provided in the sidewall of lamp receiving housing 200 is slot 207 through which extends thumb screw 206 which facilitates axial positioning of the light receiving socket (not shown) along an axial length of the lamp receiving housing. Adjustment of the lamp receiving socket (not shown) along this axial length is achieved by positioning and tightening thumb screw 206 in any selected position along slot 207 in a manner similar to that as described in greater detail below. However, and as will be readily recognized, the pivotal relationship of housing 200 to support 201 requires a separate adjustment of these two members about pivot connection 203.

Figure 3:
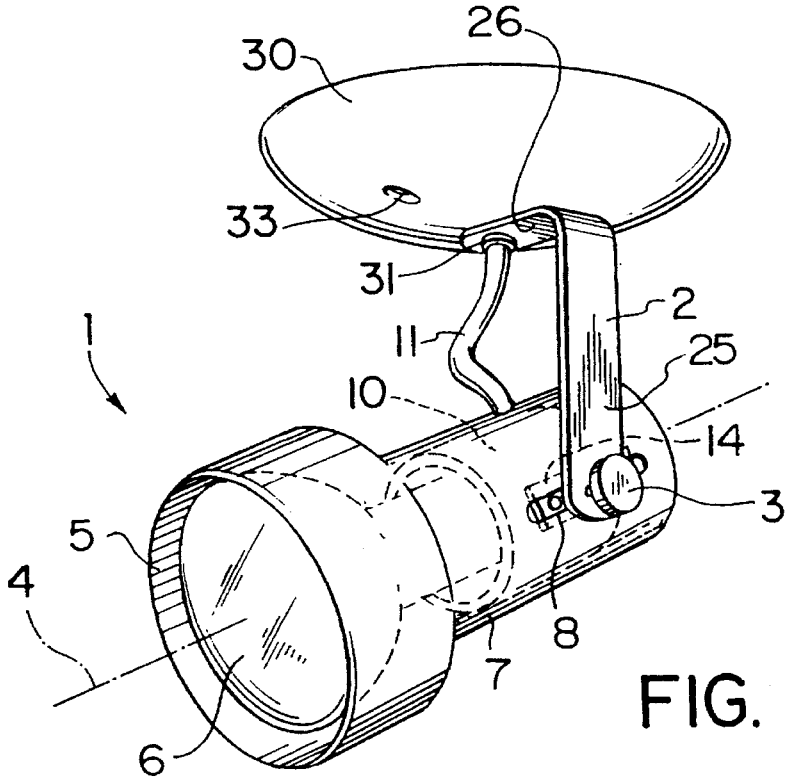
FIG. 3 is a perspective view of the electrical lamp fixture of this invention and which is shown attached to a base or cover plate.
Figure 4:
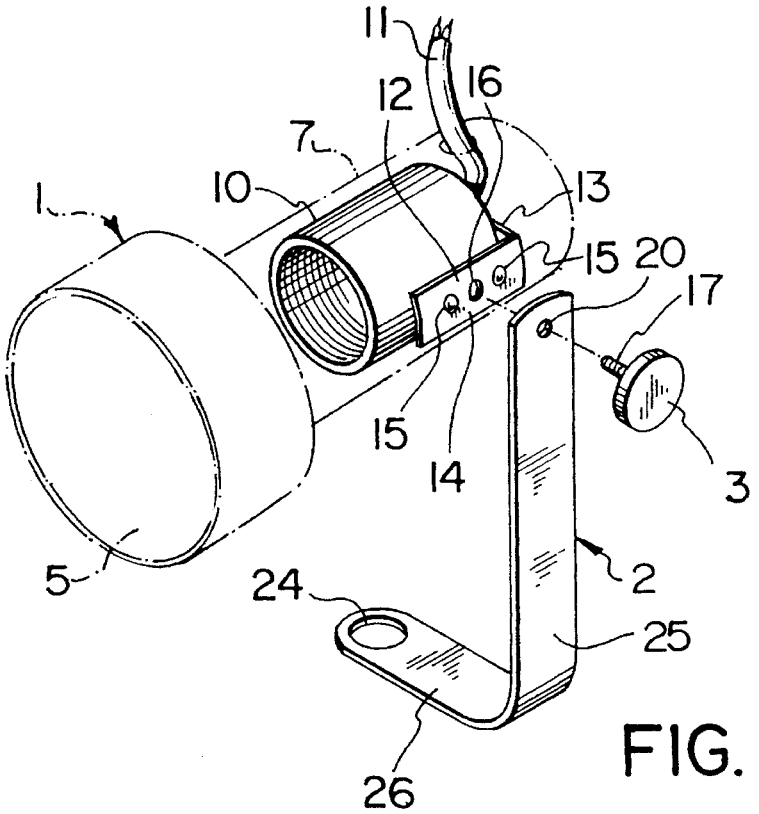
FIG. 4 is an exploded perspective view of the electrical lamp fixture of this invention.

Referring now to FIGS. 3 and 4, the external features of the novel electrical light fixture of this invention includes a lamp receiving housing generally indicated by arrow 1 and an external lamp housing support 2 which is pivotally connected to housing 1 by thumb screw 3 in a manner described in greater detail below. As illustrated in FIG. 3, the fixture itself is rotationally attached to a base or cover plate 30 by pivot connector 31 as is well known in the art. Cover or base plate 30 is itself connected by securing screws 33 to an electrical supply junction or connector box (not shown) in a manner which is also well known in the art. Although only one fixture of this invention is shown attached to base 30, it will be apparent that more than one such fixture can be attached, preferably rotationally, to a single or common base.

The lamp receiving housing 1 includes a longitudinal housing axis indicated by broken line 4 seen in FIG. 3. Housing 1 also includes an open end 5 which receives lamp 6 in a conventional manner. A sidewall portion of housing 1 and as best illustrated at 7, lies in a plane parallel to housing axis 4 and includes in this sidewall portion, an elongate slot 8 which itself, and as best seen in FIG. 3, extends in a direction parallel to axis 4 or with reference to FIGS. 6 and 7, can be inclined in sidewall 7 relative to longitudinal axis 4.

Interior of lamp housing 1 is provided lamp receiving socket 10 which is designed to receive the threaded end of lamp 6 in a known manner. Lamp 6 is energized when in socket 10 via electrical supply cable 11 in a manner which is also well known in the art.

Lamp receiving socket 10 is itself positively attached in a known manner to limb 13 of L-shaped socket support flange 12 and as best seen in FIG. 4, like the lamp receiving socket itself, is located interiorly of lamp receiving housing 1. As also seen in FIG. 4, L-shaped lamp housing support 2 is provided with aperture 20 on limb 25 through which extends the threaded portion 17 of thumb screw 3. Its other limb 26, is provided with a large aperture for receiving, if desired, pivot connector 31 as illustrated in FIG. 3.

Limb 14 of L-shaped socket support 12 is provided with threaded opening 16 which is threadedly connected to shaft 17 of thumb screw 3; shaft 17 itself extending through elongate slot 8, not seen in FIG. 4, but illustrated in FIG. 3. This permits lamp receiving socket 10 which in turn is positively connected to socket support 12 interior of housing 1 to be connected to exterior lamp housing support 2 by thumb screw 3 which extends through slot 8.

Limb 14 of L-shaped socket support 12 includes guide means which may be in the form of projections 15 located on either side of threaded opening 16 and from which the interior of sidewall 7, are designed to project into slot 8. These projections 15 serve to restrict socket support 12 from rotational misalignment as it and its accompanying lamp receiving socket to which it is positively attached is moved along an axial length of housing axis 4 in response to linear movement of thumb screw 3 along slot 8. When thumb screw 3 is partially unscrewed, the positioning of the lamp receiving socket 10 along axis 4 of housing 1 can be selectively adjusted while simultaneously permitting selective relative angular adjustment of housing 1 to is housing support 2. Upon the tightening of thumb screw 3, the selected angular adjustment of the lamp housing 1 to its support 2 and the selected axial positioning of lamp receiving socket 10 within housing 1 can be simultaneously fixed in a one step operation.

Figure 5:
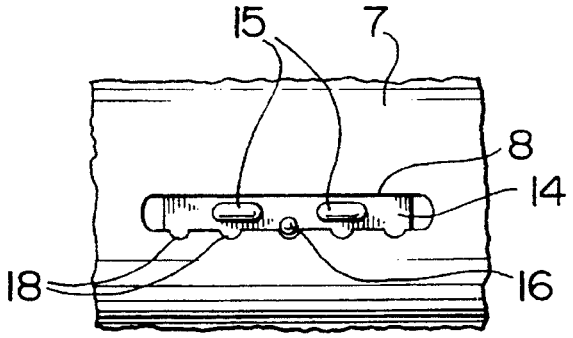
FIGS. 5, 6 and 7 are cutaway side views of a sidewall portion of the lamp housing and illustrate different sidewall slot configurations.

That portion of sidewall 7 through which elongate slot 8 extends and as seen in FIGS. 3 and 5, preferably has the elongate slot 8 extending in a direction parallel to housing axis 4. If desired, and as illustrated in FIG. 5, a series of notches 18 can be arranged along one side of the elongate slot and which are designed to hold threaded portion 17 of thumb screw 3 in position when located therein; thumb screw 3 not being shown in this Figure for ease of understanding but its relative position is being indicated by threaded opening 16.

Figure 6:
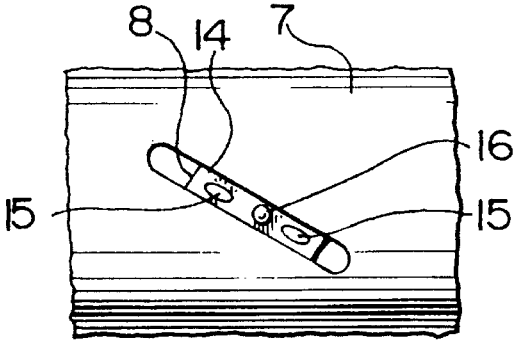
Figure 7:
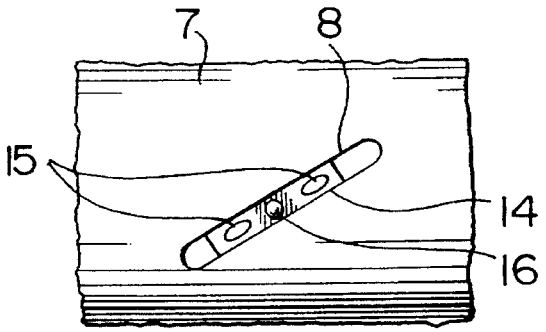

It is also possible to incline the slot located in sidewall portion 7 of lamp receiving housing 1 relative to housing axis 4 as shown in FIGS. 6 and 7 without departing from the scope of this invention. Because sidewall portion 7 of housing 1 is co-axial with housing axis 4, the lamp receiving socket will move along a portion of housing axis 4 in the desired manner but at the same time will undergo rotational movement which does not detract from its desired function.

I claim:

1. An electrical lamp fixture of the type having an elongate lamp receiving housing of unitary fixed length and which is open at one of its ends and closed at its other end, a housing axis, a housing sidewall at least a portion of which is coaxial with said housing axis, a lamp receiving socket located entirely within said lamp receiving housing, socket support means interior of said lamp receiving housing for maintaining said lamp receiving socket in alignment with said housing axis, housing support means exterior of said lamp receiving housing, and connector means for pivotally connecting said housing support means to said sidewall portion of said lamp receiving housing in selected angular relationship, said fixture being further characterized by an elongate slot provided in said portion of said housing sidewall and by said connector means which extends through said elongate slot so as to interconnect said socket support means to said housing support means and which is constrained to slidingly move to selected positions along said elongate slot and to thereby cause corresponding movement of said lamp receiving socket along a length of said housing axis interior of said lamp receiving housing.

2. The electrical light fixture as claimed in claim 1 wherein said elongate slot extends in a direction substantially parallel to said housing axis and said socket support means is constrained to slidingly move along said elongate slot by guide means which extends into said elongate slot.

3. The electrical light fixture as claimed in claim 2 wherein said lamp receiving socket, said socket support means, said housing support means and said connector means are slidingly movable along said slot relative to said lamp receiving housing.

4. The electrical light fixture as claimed in claim 3 wherein said lamp receiving housing, said lamp receiving socket and said socket support means pivot relative to said housing support means about said connector means.

5. The electrical light fixture as claimed in claim 4 wherein said connector means for pivotally connecting said housing support means to said sidewall portion of said lamp receiving housing and for connecting said socket support means to said housing support means, holds said socket support means, said lamp receiving housing and said housing support means together in frictional engagement.

6. The electrical light fixture as claimed in claim 4 which further includes a plurality of notches arranged in series along one side of said elongate slot for locating said connector means at a fixed position along said elongate slot when positioned in one of said notches.

7. The electrical light fixture as claimed in claim 4 wherein said connector means comprises a thumb screw which at one end extends through an aperture in said housing support means and which at its other end is threadedly connected to a complimentary threaded opening in said socket support means.

8. The electrical light fixture as claimed in claim 1 wherein said connector means includes means for maintaining said lamp receiving housing, said lamp receiving socket, said socket support means and said housing support means in a selected fixed relative relationship.

9. The electrical lamp fixture as claimed in claim 1 wherein said housing support means is attached to a base plate at an end of said housing support means remote from said lamp receiving housing.

* * * * *